US005139051A

United States Patent [19]

Walstad et al.

[11] Patent Number: 5,139,051

[45] Date of Patent: Aug. 18, 1992

[54] UNLOADING VALVE FOR AN AIR COMPRESSOR SYSTEM

[75] Inventors: Dennis Walstad, Elburn; Jean-Francois Couvreur, Warrenville, both of Ill.

[73] Assignee: Furnas Electric Co., Batavia, Ill.

[21] Appl. No.: 723,847

[22] Filed: Jul. 1, 1991

[51] Int. Cl.[5] ..... F16K 1/30

[52] U.S. Cl. ..... 137/630

[58] Field of Search ..... 137/629, 630

[56] References Cited

U.S. PATENT DOCUMENTS

| | | | |
|---|---|---|---|
| 650,725 | 8/1900 | Metzger | 137/630 |
| 2,376,124 | 5/1945 | Coulbourn | 137/630 |
| 2,869,584 | 1/1959 | Gordon | 137/630 |
| 3,841,353 | 10/1974 | Acomb | 137/630 |

*Primary Examiner*—A. Michael Chambers

*Attorney, Agent, or Firm*—Wood, Phillips, VanSanten, Hoffman & Ertel

[57] ABSTRACT

Start up difficulties in gas compression systems due to undersized motors and/or low voltage conditions are avoided in a system including an electrically operated compressor (10, 36) including a compression chamber (34), a compressed gas reservoir (20) connected to the compression chamber (34) to receive gas therefrom, a pressure control switch (16) associated with the reservoir (20) and operable to control operation of the compressor (10, 36) in response to the pressure level of gas within the reservoir (20), and an unloader valve (42) connected to the compression chamber (34) and operable by the switch (16) by a valve construction including a valve body (50), an inlet (62) to the valve body (50) and in fluid communication with the compression chamber (34), and an outlet (68) from the valve body (50) to the ambient. A relatively large first passage (52) is located in the valve body (50) and extends between the inlet (62) and the outlet (68). A first valve seat (70) is located in the passage (52) and a first relatively large valve member (80) is movable within the passage (52) on the inlet side of the seat (70) and is operable to close against the seat (70). A second passage (88) is located within the valve (42) in bypass relation to the valve seat (70) and a second valve seat (90) is located in the passage (88). A second, relatively small valve (92) is movable in the second passage (88) and closable against the second valve seat (90) and includes an operator (116) extending exteriorly of the valve body (50) and connected to the second valve member (92) for operation via the pressure switch (16).

30 Claims, 2 Drawing Sheets

UNLOADING VALVE FOR AN AIR COMPRESSOR SYSTEM

FIELD OF THE INVENTION

This invention relates to air compressors, and more particularly, to unloading valves useful in air compressors.

BACKGROUND OF THE INVENTION

Typical air compressor systems include an electrical motor for driving a positive displacement machine such as a reciprocating compressor. The electric motor is periodically energized as the pressure in a reservoir for the compressed air falls below a predetermined level and is deenergized once the compressor has increased the air pressure within the reservoir to a different and higher predetermined pressure level. The operating cycle is repeated over a period of time, the frequency of the cycles being dependent upon demand for the compressed air.

Those skilled in the art will readily appreciate that when the electric motor is deenergized as a result of the air pressure in the reservoir attaining the predetermined level, there will be residual air under pressure remaining in the compression chamber of the compressor at a pressure equal to that in the reservoir. Consequently, when pressure in the reservoir has been reduced to the next predetermined level, necessitating starting of the electric motor to once again drive the compressor, the electric motor must start under load as a result of the elevated pressure within the compression chamber of the compressor.

In order to achieve such a start, a larger electric motor than is required to drive the compressor in steady state conditions is required; and that is undesirable because for the vast majority of its operating cycle, such a motor is under utilized and thus only contributes to the expense of the system. To avoid this difficulty, the prior art has resorted to the use of so-called unloading valves. One example in connection with a pressure switch is illustrated in commonly assigned U.S. Pat. No. 3,875,358 issued Apr. 1, 1975 to Dale F. Willcox. The Willcox patent illustrates a pressure switch which operates in response to changes of pressure within the reservoir to alternately energize and deenergize an electric motor for driving the compressor. As is well-known, the pressure switch includes a so-called flipper which changes positions dependent upon whether the switch is opened or closed. In a preferred embodiment, the flipper is utilized to open a small valve which is connected to the compressor downstream of the compression chamber and upstream of the reservoir and a check valve associated therewith. As a consequence, each time the desired pressure level is obtained in the reservoir, the Willcox pressure switch moves its flipper to not only deenergize the electric motor driving the compressor, but to open a small valve connected to the compressor to bleed off to the ambient, any air under pressure that remains in the compression chamber and the conduit connecting the compressor to the reservoir.

As soon as air demand is such as to cause the pressure switch to reenergize the motor, the flipper again changes positions allowing the small valve to close to prevent discharge of compressed air to the ambient. In the meantime, however, the release of air under pressure from the compression chamber of the compressor allows the same to be started at a reduced load thereby allowing the use of a smaller electrical motor than would be required if the unloading valve were not utilized.

While this approach works well in most instances, occasional difficulties arise. In some instances, manufacturers, for cost savings, may attempt to use even smaller motors in the system which, of course, further reduces the starting torque available to initiate operation of the compressor. Even when the motor size is adequate, in instances where the voltage for driving the motor is low (for example when the system is connected to electrical power through a relatively long extension cord) again there may be insufficient torque to properly start the system. In particular, increasing resistance, and thus increasing load upon the motor, begins as soon as the compressor begins to constrict the volume of its compression chamber to compress air and in those instances as identified above, the difficulty may be encountered.

In order to avoid this difficulty, it has been proposed to utilize a normally open valve of relatively large size in lieu of the typical, relatively small, normally closed unloader valve as represented by the above-identified Willcox patent. In this case, the valve is pressure responsive and normally will be open whenever the compressor is started and is operating at reduced speed. That is to say, the valve will remain open so long as the compressor has not been brought up to full speed. As a consequence, the air being compressed by the compressor during start up will be discharged while the compressor is running relatively slowly even though it is accelerating to maintain a low load on the electrical motor throughout the starting process. Once the compressor gets up to speed, it will be operating on a sufficient volume of air so that the resulting pressure applied against the valve is sufficient to close it to prevent further discharge of air to the ambient for unloading purposes.

This system allows the use of smaller motors than those heretofore known, but is not without its own problems In order to be effective during the vast majority of the start up portion of the cycle, the valve must be relatively large and thus the same will have a relatively large pressure responsive surface. As a consequence, when the motor deenergizes, there is a substantial force from residual air under pressure tending to maintain the valve closed; and the pressure switch or other operator that must be utilized to open the valve to release residual gas under pressure to ambient must accordingly be made more powerful to operate successfully against the larger force. Thus, any advantage in reduction of motor size or ability to operate properly under low voltage conditions is partially or wholly offset by the requirement for a more powerful operator to open the valve following deenergization of the electric motor.

The present invention is directed to overcoming one or more of the above problems.

SUMMARY OF THE INVENTION

It is the principal object of the invention to provide a new and improved valve that may be utilized as an unloading valve in an air or gas compressing system. It is also an object of the invention to provide a new and improved pilot operated valve and an air or gas compressing system utilizing such a valve.

According to one facet of the invention, the foregoing objects are realized in a valve including a valve body, an inlet to the valve body adapted to be in fluid communication with the compression chamber of a compressor; and outlet from the valve body to the ambient; a relatively large first passage in the body extending between the inlet and the outlet, and a first valve seat in the passage. A first, relatively large valve member is movable within the passage on the inlet side of the seat and operable to close against the seat. A second passage is located within the valve and is in bypass relation to the first valve seat. A second valve seat is located in the second passage and a second, relatively small valve is movable in the second passage and closable against the second valve seat. An operator extends exteriorly of the valve body and is connected to the second valve member.

According to the invention, a relatively small force may be applied to the operator to open the second valve against internal pressure within the system. Because the second valve is relatively small, only a relatively small force is required to open it. Because the second valve will, when open, open the bypass about the first valve seat, residual pressure in the system tending to close the first valve is released by the second valve such that the first valve may now be opened with a relatively small force.

In a preferred embodiment of the invention, the second passage is formed in the first valve member itself. Preferably, the second valve seat is formed in the first valve member and the second valve member is mounted for movement in the first valve member.

The invention also contemplates the provision of means within the valve body for biasing the first valve member away from the first valve seat, that is, to provide a normally opened valve.

In a highly preferred embodiment, the first valve seat is defined by an annular, generally axially facing surface in the first passage which faces the inlet. A plug is disposed in the first passage between the inlet and the seat and is spaced from the surface defining the seat. The first valve member is located between the plug and the surface and is retained in the passage by the plug.

In a highly preferred embodiment, means are provided in the valve to establish a flow path past the plug. The invention contemplates that such establishing means include a passage in the plug which is of a size smaller than the first valve member. The establishing means may also comprise at least one axial groove at the interface of the plug and the valve body.

In a highly preferred embodiment of the invention, such a valve is incorporated in a gas compressing system including an electrically operated compressor having a compression chamber, a compressed gas reservoir connected to the compression chamber to receive gas therefrom, a pressure control switch associated with the reservoir and operable to control operation of the compressor in response to the pressure level of gas within the reservoir. The valve is employed as an unloader valve and is connected to the compression chamber and operated by the switch such that the compressor is not started by the switch with gas at an elevated pressure in the compression chamber.

According to another facet of the invention, a pilot operated valve including a valve body is provided. A stepped passage is disposed in the valve body and includes a first, relatively large diameter section which is adapted to serve as an inlet, a second, small diameter section opening to the exterior of the valve body, and a third intermediate diameter section located between the first and the second sections.

The interface of the first and third sections defines a generally axially facing valve seat and an outlet is disposed in the valve body in fluid communication with the third section.

A poppet is located in the first section and is of a diameter greater than the third section and has a valve surface for sealing against the valve seat. Oppositely of the valve seat, the poppet includes a pressure responsive surface facing the first section. The poppet also includes a pilot passage opening at opposite ends to the first and third sections and a pilot valve seat. A pilot valve having a surface facing the first section and of considerably lesser area than the area of the pressure responsive surface of the poppet valve is mounted in the poppet valve for movement toward and away from the pilot valve seat. An actuator is provided for moving the pilot valve and extends through the pilot passage and the second section to the exterior of the valve body.

In a preferred embodiment, a spring is disposed in the third section which engages the poppet and biases the same away from the seat.

In a highly preferred embodiment, the outlet and the opening of the second section to the exterior of the valve body are different from one another.

In a highly preferred embodiment, the first section opposite the valve seat includes a plug for retaining the poppet therein while allowing movement thereof relative to the valve seat.

The invention also contemplates the use of a plug for retaining the pilot valve within the valve body while allowing movement thereof relative to the pilot valve seat.

In a preferred embodiment, the plug is operative to retain both the poppet and the pilot valve.

In one embodiment, the plug may include a generally central bore of a diameter less than that of the pilot valve.

The invention also contemplates that the poppet, on the side thereof facing the plug, includes stand offs engageable with the plug for preventing the poppet from sealing against the plug.

Preferably, the plug is tapered and is force fit within the first passage.

Other objects and advantages of the invention will become apparent from the following specification taken in connection with the accompanying drawings.

DESCRIPTION OF THE PREFERRED EMBODIMENT

Figure 1:
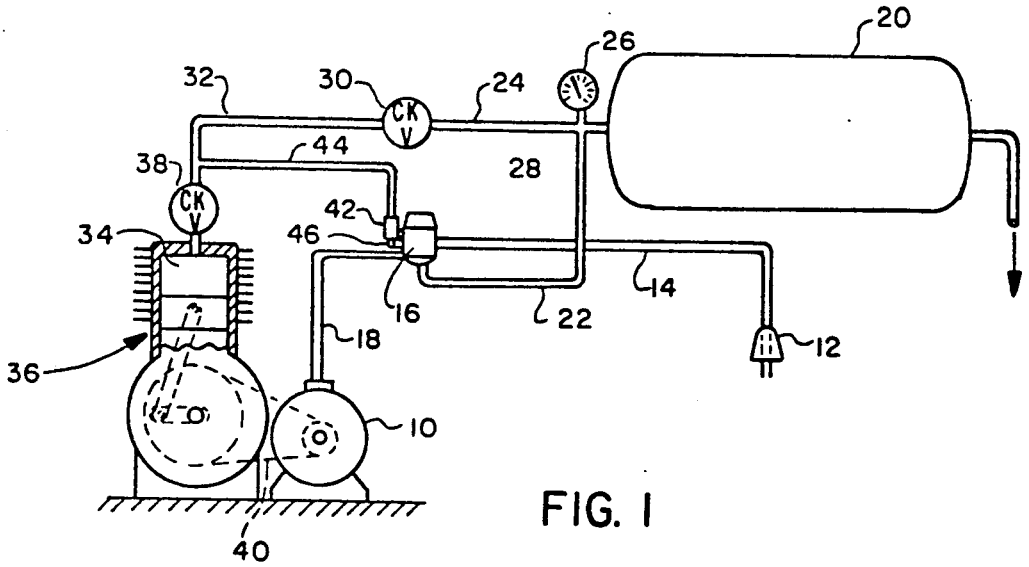
FIG. 1 is the somewhat schematic view of a gas compressing system made according to the invention.

A typical gas compression system made according to the invention and embodying a valve made according to the invention is illustrated in FIG. 1. With reference thereto, there is illustrated an electric motor 10 which ultimately receives power from a power source (not shown) to which it may be connected by a conventional plug 12. A cord 14 extends from the plug 12 to a pressure switch 16 which may be of conventional construction as, for example, that illustrated in the previously identified Willcox patent, the details of which are herein incorporated by reference. The pressure switch 16 is operative to supply power to energize or deenergize the motor 10 on leads 18 in response to pressure changes within a reservoir 20. To this end, a conduit 22 extends between the pressure switch 16 and a supply conduit 24 through which gas under pressure is introduced into the reservoir. Desirably, one or more pressure gauges 26 are associated with the system.

Upstream of the junction 28 of the conduits 22 and 24, the latter includes a conventional check valve 30 which permits flow toward the reservoir 20, but prevents back flow. The check valve 30 is connected via a conduit 32 to the compression chamber 34 of a reciprocal compressor, generally designated 36, of known construction. As is well known, the compressor 36 also includes in its head, an internal check valve shown schematically at 38. A belt 40 interconnects the motor 10 and the compressor 36 so that the former may drive the latter when the former is energized.

A valve 42 made according to the invention is connected via a conduit 44 to the conduit 32 which is to say, the valve 42 is connected to the system between the compression chamber 34 and the check valve 30 to be in fluid communication with the compression chamber 34. The valve 42 is operated by a conventional flipper 46 extending from the pressure switch 16. The flipper 46 changes position with the opening and closing of the pressure switch 16 as mentioned previously. The arrangement is such that residual gas under pressure within the compression chamber 34 and the conduit 32 is discharged to the ambient by the valve 42 when the pressure switch 16 deenergizes the motor 10. And, as will be seen in greater detail hereinafter, the arrangement is such that the valve 42 will discharge, to the ambient, air being compressed within the compression chamber 34 during the start up portion of a compression cycle to unload the motor 10 thereby allowing easy start up with a relatively slow motor or under low voltage conditions.

Figure 3:
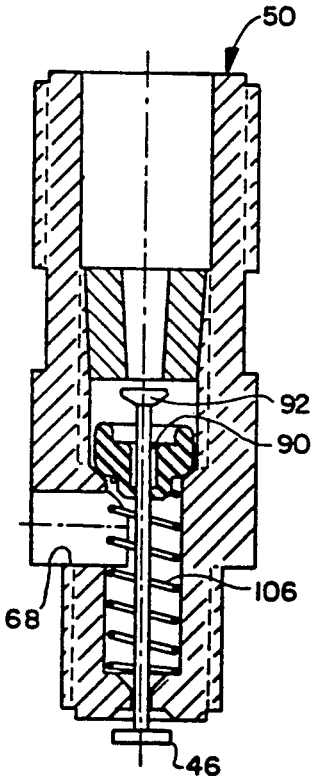
FIG. 3 is a view similar to FIG. 2, but showing the pilot valve in an open position and the poppet in a closed position.
Figure 4:
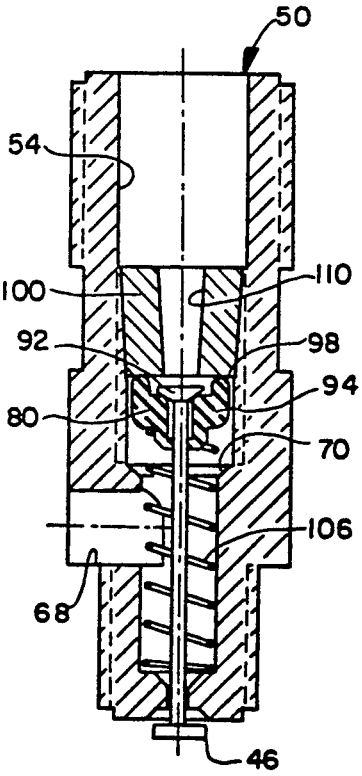
FIG. 4 is a view similar to FIGS. 2 and 3, but showing the poppet in an open position.
Figure 5:
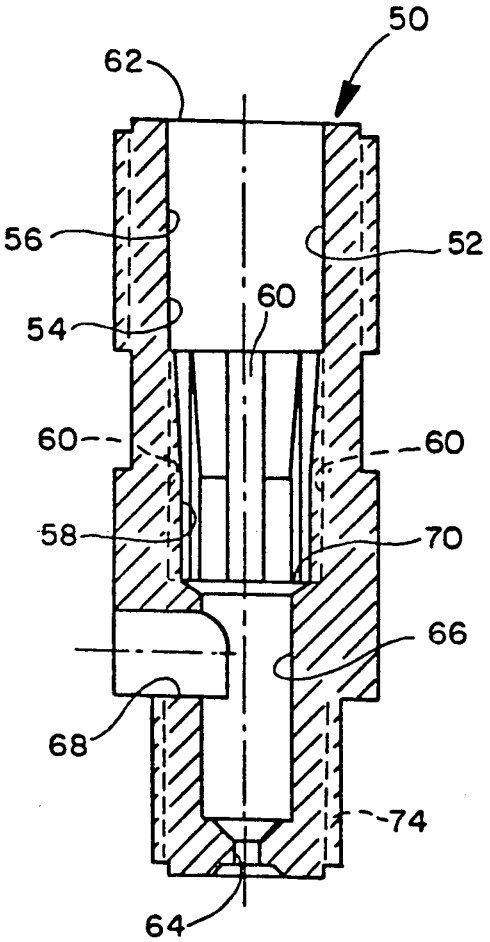
FIG. 5 is a sectional view of the body of the valve of FIGS. 2–4.
Figure 6:
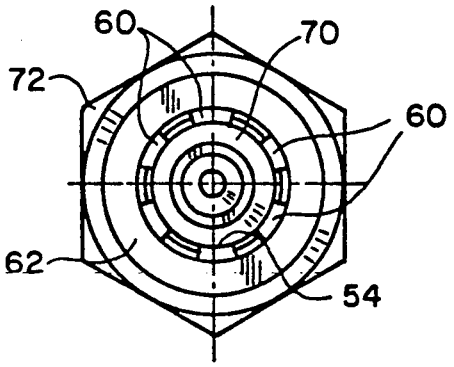
FIG. 6 is a plan view of the valve body.

Turning now to FIGS. 2-5, inclusive, the valve 44 is seen to include an elongated valve body, generally designated 50. Within the valve body is a stepped passage 52. As best seen in FIG. 5, the stepped passage 52 includes a first, relatively large diameter section 54, which in turn is made up of a smooth, cylindrical bore 56 and a slightly tapered part 58 which includes a plurality of generally axially extending, radially inwardly opening grooves 60.

An end 62 of the first section 54 is adapted to serve as an inlet to the valve 42 and would typically be connected to the conduit 44 (FIG. 1) in the usual form of an installation.

At the opposite end of the body 50, the passage 52 includes a second, small diameter section 64 which opens to the exterior of the body 60. Between the first and second sections 54 and 64, there is an intermediate diameter third section 66. A radially extending outlet port 68 in the side of the body 50 extends to the second section 66 and is in fluid communication therewith.

It is to be particularly noted that the interface between the first section 54 and the third section 66 defines a generally axially facing, annular valve seat 70 which faces the inlet end 62.

Preferably, at any desired location along its length, the valve body 52 is provided with a hex formation 72 for installation purposes. In addition, the lower end of the body adjacent the small diameter section 64 may be threaded as schematically illustrated at 74 to receive a nut or the like whereby the valve body 50 may be secured to a mounting bracket or the like.

Disposed within the first section 54 of the passage 52 adjacent the seat 70 is a poppet 80. A seen in FIG. 2, the undersurface of the poppet 80 may seal against the seat 70. As can be ascertained from FIG. 8, the poppet 80 may be made of any suitable elastomer and includes a large diameter section 82 and a reduced diameter section 84. A rounded shoulder 86 interconnecting the sections 82 and 84 is that part which seals against the seat 70.

Figure 2:
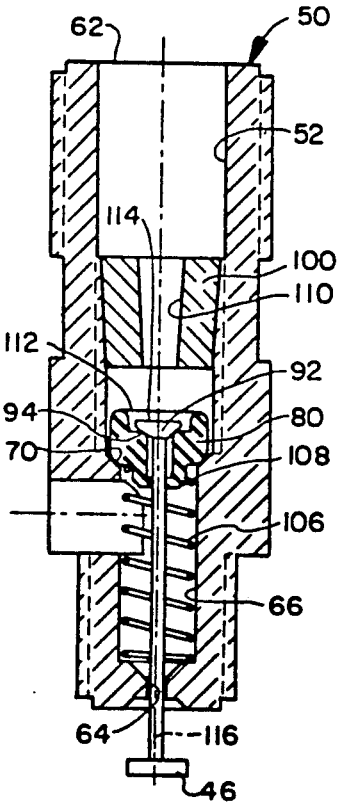
FIG. 2 is a sectional view of a valve made according to the invention showing both a poppet and a pilot valve in a closed position.

The poppet 80 also includes an internal, central passage 88 which serves as a bypass passage about the seat 70 when the poppet 80 is seated for purposes to be seen. The upper end of the passage 88 terminates in a rounded shoulder 90 which serves as a valve seat for a pilot valve 92. Specifically, and as seen in FIGS. 2 and 4, the undersurface 94 of the pilot valve 92 may seal against the seat defined by the shoulder 90 to close the passage 88.

Figure 7:
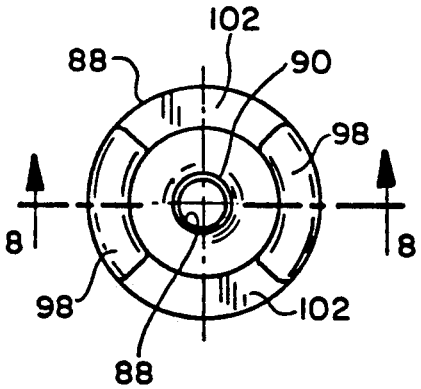
FIG. 7 is a plan view of the poppet used in the valve.
Figure 8:
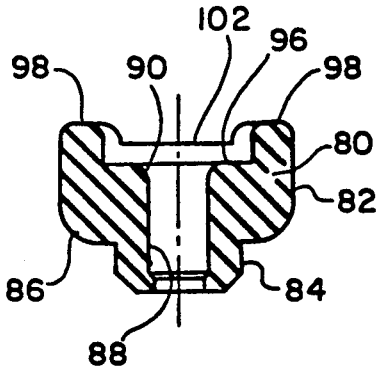
FIG. 8 is a sectional view of the poppet taken approximately along the line 8—8 in FIG. 7.

Returning to the poppet 80, as can be seen from FIGS. 7 and 8, on its surface 96 opposite the shoulder 86 which seals against the seat 70, the same is provided with at least two axially extending standoffs 98. As can be seen from FIG. 4, the standoffs 98 may abut the underside of a retaining plug 100 located within the first section 54 of the passage 52 when the poppet 80 is displaced from the seat 70 and prevent the poppet 80 from sealingly engaging the plug 100 by reason of the spaces 102 between the standoffs 98. The purpose of this construction will become apparent hereinafter.

Returning to FIG. 2, a compression coil spring 106 is located in the third section 66 of the passage 52 and has its upper end 108 piloted into engagement with the poppet 80 about the reduced diameter section 84. The compression coil spring is normally operative to bias the poppet 80 to the position illustrated in FIG. 4.

The plug 100 serves the purpose of retaining both the poppet 80 and the pilot valve 92 within the valve body 50. As mentioned previously, the end 62 of the valve body 50 is intended to serve as an inlet and in order to allow air under pressure to flow to the poppet 80, the grooves 60 are provided. The grooves 60 extend about the plug 100 all the way to the edge of the valve seat 70. In order to avoid any undesirable flow restriction, the plug 100 is also provided with a central opening 110 which supplements the flow passages provided by the grooves 60. It will be observed that the end of the opening 110 opening towards the poppet 80 and the pilot valve 92 is of smaller size than either to insure that the plug 100 performs its intended function of retaining both the poppet 80 and the pilot valve 92 within the valve body 50.

In this regard, however, it will be appreciated that when the poppet 80 is in the position illustrated in FIG. 4, flow of gas through the passage 110 will not be blocked by the poppet 80 because of the presence of the recesses 102 between the standoffs 98.

It can be readily appreciated from FIGS. 2–4 that the pressure responsive surface area of the poppet 80 facing the inlet end 62, that is, the area represented by the upper end 112 of the poppet 80, is considerably greater than the pressure responsive, upper surface 114 of the pilot valve 92. Thus, the presence of a gas under pressure at the inlet 62 will be exerting a greater total force on the poppet 80 to urge the same to the position illustrated in FIG. 2 than will be exerted on the pilot valve 92, also urging the pilot valve 92 to the closed position illustrated in FIG. 2.

Finally, a rod-like operator 116 is connected to the pilot valve 92 oppositely of the surface 114 and extends to the exterior and outwardly of the valve body 50 through the second section 64 of the passage 52. As can be seen in FIG. 2, the lower end of the operator 116 is adapted to be mounted in substantial abutment with the flipper 46 of the pressure switch 16 (FIG. 1).

Operation is as follows. Assuming that the electric motor 10 has been energized by the pressure switch 116 and the same is operating in a steady state condition, the components will have the configuration illustrated in FIG. 2. That is to say, the flipper 46 will be in a relatively lower most position in relation to the operator 116 and air under pressure from the compressor 36 and entering the inlet end 62 via the conduit 44 will be exerting sufficient force against the upper surface 112 of the poppet 80 and the upper surface 114 of the pilot valve 92 so that the former will move downwardly against the bias of the spring 106 to sealingly engage the seat 70 and the pilot valve 92 will be sealed against the shoulder 94 defining the pilot valve seat in the poppet 80. As a consequence, all compressed air will be directed via the conduit 32 through the check valve 30 and ultimately to the reservoir 20.

As pressure builds up within the reservoir 20, that is sensed by the pressure switch 16 via the conduit 22. When the desired pressure within the reservoir 20 is achieved, the pressure switch 16 will open to deenergize the motor 10. Simultaneously, the flipper 46 will move upwardly and open the pilot valve 92 as a result of engagement with the operator 116. This configuration is illustrated in FIG. 3 and will occur with very little effort for the reason that the pressure responsive surface 114 of the pilot valve 92 is quite small so the total force urging the pilot valve 92 against its seat defined by the shoulder 96 will likewise be relatively small and easily overcome by the force provided by the pressure switch 16 via the flipper 46.

As the pilot valve 92 opens, it opens the bypass passage 88 from the inlet end 62 of the valve body 50 to the outlet 68, allowing residual gas under pressure in the compression chamber 34 of the compressor 36 as well as in the conduit 32 to bleed to the ambient. As this pressure bleeds off, the force acting against the poppet 80 to close the same against the seat 70 against the bias of the spring 106 is reduced until finally, the force provided by the spring 106 causes the poppet 80 to open. This is shown in FIG. 4. Any remaining pressurized air rapidly discharges via the outlet 68.

More importantly, the valve 42 is now in an open position and with the poppet 80 open, provides a relatively large flow path for air from the compressor 36. Consequently, the next time that the pressure switch 16 energizes the motor 10, initially the majority of the air being compressed within the compression chamber 34 of the compressor 36 will pass through about the now open poppet 80 to be discharged to the ambient via the outlet 68. As the motor 10 picks up speed in the starting sequence, a greater quantity of air will be compressed and, due to resistance within the system, the pressure will begin to build. This pressure will, of course, act against the surface 112 of the poppet 80 and at about the time the motor 10 is operating at full speed, be sufficient to cause the poppet 80 to return to the position illustrated in FIG. 2. The pilot valve 92 will also return to that position under the influence of the elevating pressure and/or gravity if the valve is mounted in the position illustrated in FIGS. 2–4. At this time, the flipper 46 will have returned to the position illustrated in FIG. 2 upon the pressure valve 16 closing to energize the motor. Consequently, it does not obstruct the pilot valve 92 and prevent it from returning to the position illustrated in FIG. 2.

For so long as the motor 10 remains energized, the valve will remain closed to prevent undesirable discharge through the valve 42 and wastage of energy. However, as soon as the pressure switch 16 again opens, the flipper 46 will open the pilot valve 92 and the entire cycle may again be repeated.

From the foregoing, it will be readily appreciated that a system and valve made according to the invention possess substantial advantages in allowing the use of a smaller motor in driving the compressor and/or minimize or prevent start up difficulty under low voltage circumstances. Importantly, this is achieved without requiring an increase in the strength of the operational system for operating the unloader valve by reason of the unique provision of the pilot valve 92 of relatively small size that may be easily opened, even against the elevated pressure that may be present in the system. Consequently, the advantage does not sacrifice a relatively small pressure switch for a larger one in order to achieve the ability to employ a smaller motor or obtain reliable starts in low voltage conditions.

We claim:

1. In a gas compressing system including an electrically operated compressor including a compression chamber, a compressed gas reservoir connected to the compression chamber to receive gas therefrom, a pressure control switch associated with the reservoir and operable to control operation of the compressor in response to the pressure level of gas within said reservoir, and an unloader valve connected to said compression chamber and operated by said switch such that said compressor is not started by said switch with gas under an elevated pressure in said compression chamber, the improvement wherein said unloader valve includes:

a valve body;

an inlet to said valve body and in fluid compression with said compression chamber;

an outlet from said valve body to the ambient;

a relatively large first passage in said body extending between said inlet and said outlet;

a first valve seat in said passage;

a first relatively large valve member movable within said passage on the inlet side of said seat and operable in response to operation of said compressor to close against said seat;

a second passage within said unloader valve and in bypass relation to said first valve seat;

a second valve seat in said second passage;

a second relatively small pilot valve movable in said second passage and having a first pressure responsive surface exposed to said inlet and an opposite surface closable against said second valve seat; and an operator extending exteriorly of said valve body and connected to said second valve member, said operator extending to said switch to be engageable therewith and movable thereby in opposition to move said pilot valve away from said second valve seat.

2. The gas compressing system of claim 1 wherein said second passage is formed in said first valve member.

3. The gas compressing system of claim 2 wherein said second valve seat is formed in said first valve member and said second valve member is mounted for movement in said first valve member.

4. The gas compressing system of claim 1 further including means within said valve body for biasing said first valve member away from said first valve seat.

5. The gas compressing system of claim 1 wherein said first valve seat is defined by an annular, generally axially facing surface in said first passage facing said inlet and further including a plug in said first passage between said inlet and said seat and spaced from said surface; said first valve member being located between said plug and said surface and being retained in said passage by said plug.

6. The gas compressing system of claim 5 further including means in said valve establishing a flow path past said plug.

7. The gas compressing system of claim 6 wherein said establishing means comprise a passage through said plug and of a size smaller than said first valve member.

8. The gas compressing system of claim 6 wherein said establishing means comprise at least one axial groove at the interface of said plug and said valve body.

9. The gas compressing system of claim 8 wherein said establishing means further includes a passage through said plug and of a size smaller than said first valve member.

10. A valve comprising:

an inlet to said valve body;

an outlet from said valve body;

a relatively large first passage in said body extending between said inlet and said outlet;

a first valve seat in said passage;

a first relatively large valve member movable within said passage on the inlet side of said seat and operable to close against said seat;

a second passage within said valve and in bypass relation to said first valve seat;

a second valve seat in said second passage;

a second relatively small pilot valve movable in said second passage and having a pressure responsive surface exposed to said inlet and an opposed surface closable against said second valve seat; and an operator extending exteriorly of said valve body and connected to said second valve member for receiving an opening force in opposition to pressure acting on said pressure responsive surface to urge said pilot valve away from said second valve seat.

11. The valve of claim 10 wherein said second passage is formed in said first valve member.

12. The valve of claim 11 wherein said second valve seat is formed in said first valve member and said second valve member is mounted for movement in said first valve member.

13. The valve of claim 10 further including means within said valve body for biasing said first valve member away from said first valve seat.

14. The valve of claim 10 wherein said first valve seat is defined by an annular, generally axially facing surface in said first passage facing said inlet and further including a plug in said first passage between said inlet and said seat and spaced from said surface; said first valve member being located between said plug and said surface and being retained in said passage by said plug.

15. The valve of claim 14 further including means in said valve establishing a flow path past said plug.

16. The valve of claim 15 wherein said establishing means comprise a passage through said plug and of a size smaller than said first valve member.

17. The valve of claim 15 wherein said establishing means comprise at least one axial groove at the interface of said plug and said valve body.

18. The valve of claim 17 wherein said establishing means further includes a passage through said plug and of a size smaller than said first valve member.

19. A valve comprising:

a valve body;

a stepped passage extending through said valve body including a first, relatively large diameter section and adapted to serve as an inlet;

a second, small diameter section opening to the exterior of the valve body; and a third, intermediate diameter section located between said first and second sections;

the interface of said first and third sections defining a generally axially facing valve seat;

an outlet in said valve body in fluid communication with said third section;

a poppet in said first section and of a diameter greater than said third section and having a valve surface for sealing against said valve seat and an opposed pressure responsive surface facing said first section, said poppet further including a pilot passage opening at opposite ends to said first and third sections and a pilot valve seat;

a pilot valve having surface facing said first section of considerably lesser area than the area of said pressure responsive surface of said poppet valve and mounted in said poppet valve for movement toward and away from said pilot valve seat; and an actuator for moving said pilot valve extending through said pilot passage and said second section to the exterior of said valve body.

20. The valve of claim 19 further including a spring in said third section for engaging said poppet and biasing the same away from said seat.

21. The valve of claim 19 wherein said outlet and the opening of said second section to the exterior of the valve body are different from one another.

22. The valve of claim 19 wherein said first section opposite of said valve seat includes a plug for retaining said poppet therein while allowing movement thereof relative to said valve seat.

23. The valve of claim 19 wherein said first section opposite of said pilot valve seat includes a plug for retaining said pilot valve therein while allowing movement thereof relative to said pilot valve seat.

24. The valve of claim 23 wherein said plug further retains said poppet while allowing movement relative to said valve seat.

25. The valve of claim 24 wherein said plug includes a generally central opening of a diameter less than said pilot valve.

26. The valve of claim 25 wherein said poppet, on the side thereof facing said plug, includes stand offs engageable with said plug for preventing said poppet from sealing against said plug.

27. The valve of claim 22 wherein said plug engages the interior of said passage within said first section and further including grooves at the interface of said plug and said body for defining a fluid bypass about said plug.

28. The valve of claim 27 wherein said grooves are formed in said body and extend to said valve seat.

29. The valve of claim 22 wherein said plug is tapered and is force fit within said first passage.

30. The valve of claim 24 wherein said plug includes a generally central opening configured to retain said pilot valve.

* * * * *